United States Patent [19]

Datta et al.

[11] Patent Number: 4,968,413

[45] Date of Patent: Nov. 6, 1990

[54] PROCESS FOR BENEFICIATING OIL SHALE USING FROTH FLOTATION

[75] Inventors: Rabinder S. Datta, Pittsburgh, Pa.; Charles A. Salotti, San Ramon, Calif.

[73] Assignee: Chevron Research Company, San Francisco, Calif.

[21] Appl. No.: 79,547

[22] Filed: Jul. 29, 1987

Related U.S. Application Data

[63] Continuation of Ser. No. 768,901, Aug. 22, 1985, abandoned.

[51] Int. Cl.[5] ..... C10G 1/04

[52] U.S. Cl. ..... 208/390; 208/391

[58] Field of Search ..... 208/390, 391

[56] References Cited

U.S. PATENT DOCUMENTS

| | | | |
|---|---|---|---|
| 3,422,000 | 1/1969 | Bichard | 208/391 |
| 3,973,734 | 8/1976 | Rosar et al. | 208/391 |
| 4,120,776 | 10/1978 | Miller et al. | 208/391 |
| 4,120,777 | 10/1978 | Globus | 208/391 |
| 4,425,227 | 1/1984 | Smith | 208/391 |
| 4,474,616 | 10/1984 | Smith et al. | 208/391 |
| 4,486,294 | 12/1984 | Miller et al. | 208/391 |
| 4,491,512 | 1/1985 | Euker | 208/390 |

FOREIGN PATENT DOCUMENTS

| | | | |
|---|---|---|---|
| 491955 | 4/1953 | Canada | 208/390 |
| 586229 | 11/1959 | Canada | 208/390 |
| 614697 | 2/1961 | Canada | 208/390 |
| 638886 | 3/1962 | Canada | 208/390 |
| 2044796 | 10/1980 | United Kingdom | 208/390 |

*Primary Examiner*—Asok Pal

[57] ABSTRACT

A process for beneficiating oil shale is disclosed including the steps of grinding the shale to fine particles in an aqueous medium, portions of which are kerogen-rich and kerogen-poor, scrubbing the particles, conditioning using a collector and a frother, and separating using froth flotation and oil agglomeration/dewatering.

23 Claims, 1 Drawing Sheet

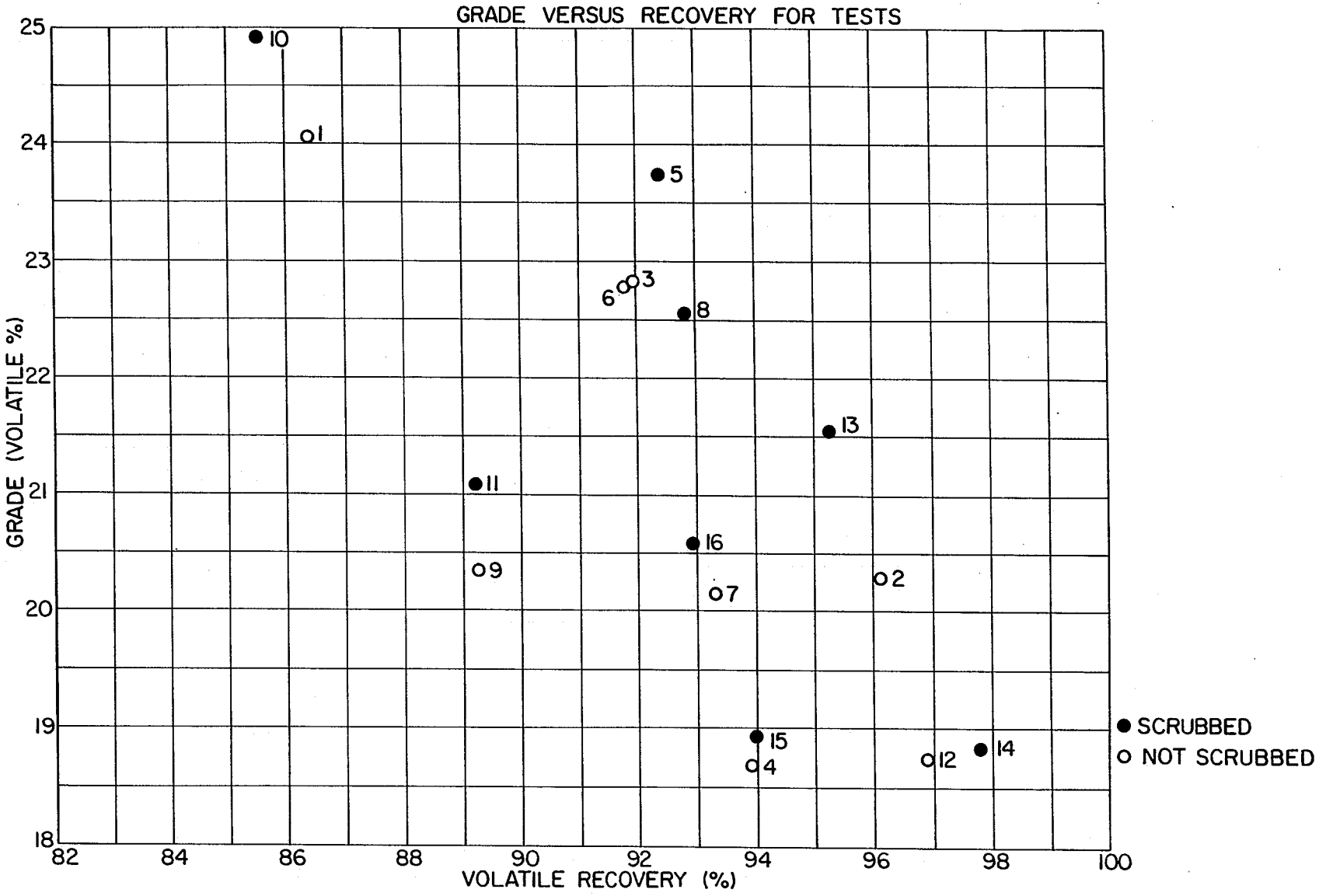
FIG. I.

PROCESS FOR BENEFICIATING OIL SHALE USING FROTH FLOTATION

This is a continuation of application Ser. No. 768,901, filed 8/22/85, now abandoned.

BACKGROUND OF THE INVENTION

The eventual commercial production of shale oil in sufficient quantities to constitute a significant replacement of petroleum oil will involve the handling of enormous quantities of inert inorganic mineral refuse in the process of recovering the kerogen content from the oil shale. For example, commercially recoverable oil shale generally contains from about 85 percent to about 95 percent mineral matter, with the kerogen-rich material constituting a very minor proportion of the overall in-place oil shale. This large amount of inorganic mineral matter interferes with subsequent processing in a number of ways. For example, in retorting the shale, very large and/or numerous retorts are required to handle the commercial quantities involved. Furthermore, a substantial quantity of heat is expended and lost in heating up the shale to retorting temperature and cooling it down. Additionally, the retorting procedure is a source of contaminating fines, the greater the quantity of shale, the greater the quantity of fines. A further source of pollution is the spent shale recovered from the retort. In the process of retorting, a multitude of chemical reactions are caused to occur in the shale in the process of volatilizing the kerogen. This results in a remnant of chemical compounds in the spent shale leaving the retort. Since these remnant compounds are not naturally occurring, they constitute a potential environmental pollutant in the discarded shale and present a particular hazard in surface water pollution. As a result, an economic process which significantly reduces the amount of oil shale which must be handled and treated to yield a given amount of kerogen and which significantly reduces the amount of polluting shale waste would be advantageous.

Various oil shale beneficiating procedures have been proposed. Those separations most proposed are predicated on the differential occurrence of kerogen in the various lumps, pieces and particles of oil shale following the various methods of size reduction and comminution. Since the larger pieces in a reduced shale tend to have a higher kerogen content, simple screening can effect a beneficiation, as described in U.S. Pat. No. 3,133,010. Since kerogen-rich particles possess a lower specific gravity, gravity separation in a dense liquid can also effect a moderate separation, as also mentioned in the reference above. Since kerogen-rich particles differ in wettability from kerogen-poor particles, separation in an aqueous medium by froth flotation is also a significant means of segregating kerogen from the inorganic mineral matter, one method of which is described in U.S. Pat. No. 3,973,734. However, to date none of these proposed oil shale beneficiation procedures has been proven wholly economically effective.

In an acceptable beneficiation procedure, a substantial portion of the inorganic mineral matter will be segregated in a kerogen-poor phase which can be discarded without significant loss of kerogen, and a kerogen-rich phase of substantially reduced weight for kerogen recovery For example, a beneficiation procedure in which less than 10 percent of the kerogen is discarded and in which the kerogen-rich portion is less than 25 percent of the beneficiation feed would be regarded as a substantial accomplishment.

SUMMARY OF THE INVENTION

Comminuted oil shale is separated into a discardable portion having a low kerogen content and a high kerogen content portion suitable for shale oil recovery. In this process, oil shale is mixed and reduced to a size suitable for grinding. This sized product is then ground in an aqueous suspension until it is sufficiently fine that a substantial portion of the mineral matter is present as minute particles substantially free of kerogen. These kerogen-poor particles are separated from the remaining kerogen-rich particles by a froth flotation procedure. In an intermediate stage between the grinding and the froth flotation, the concentrated suspension of finely ground oil shale particles is subjected to scrubbing or turbulent agitation, such as by a rotating impellar, and a conditioning dispersant in order to scrub the particles and make them more hydrophobic. This shear treatment enhances the separation of the kerogen-poor particles from the kerogen-rich particles in the subsequent froth flotation procedure.

BRIEF DESCRIPTION OF THE DRAWINGS

FIG. 1 is a chart of grade versus recovery of the process of the present invention, comparing scrubbed versus non-scrubbed examples.

DETAILED DESCRIPTION OF THE INVENTION

In this invention the differences in the physical and chemical properties of the kerogen and the mineral matter of an oil shale are utilized to beneficiate the oil shale under controlled conditions. By controlling the dispersion of the particles in an aqueous slurry and preparing the particles' surface so that the kerogen-rich particles are more hydrophobic than the kerogen-lean mineral matter, significant beneficiation can be achieved, particularly using subsequent froth flotation and oil agglomeration principals.

The beneficiation process is carried out in a series of process steps or stages, each of which is independently critical to the success of the system:

SIZE REDUCTION STEP

Initially, the kerogen-containing oil shale needs to be reduced in size to provide an initial or preliminary liberation of the inorganic components. This is ordinarily accomplished by mechanical grinding.

Raw oil shale is ordinarily precrushed using an impact crusher to rod mill feed size, about ¾" to 1" average diameter. This feed is mixed with water to aid further grinding, to constitute an aqueous mixture of between about 40% to 65% solids, and preferably about 50% solids. The precrushed shale/water mixture is then fed to any standard mill which may be tumbling ball mill, rod mill, autogenous mill or pebble mill, or any combination, for grinding to the desired size.

During grinding, however, metal ions are released from the mineral component of the shale, primarily due to the temperature rise resulting from the mechanical grinding action. These metal ions, in turn, react with the organic component of the shale, flocculating the material into a gel-like state, and substantially increasing the viscosity of the feed. The more viscous the feed, the more difficult to grind to the desired fineness and the more energy is required. To control the rheology of the suspension, therefore, and reduce the energy and cost of grinding, a dispersant is added to the mixture. The dispersant can prevent the adverse effect of the metal ions and reduce the viscosity in either of two ways. First, the dispersant can act as a sequestering agent, reacting with the metal ions and taking them out of suspension. Preferred sequestering agents include phosphates, a most preferred phosphate for the present invention being sodium hexametaphosphate (SHMP). SHMP would ordinarily be added in a concentration of from about 0.1 to about 0.4% by weight of the solids, (2 lb/ton to 8 lb/ton) and preferably around 0.1% by weight.

Alternatively, dispersants may be used which prevent dissolution of the metal ions into the system in the first place. Preferred agents of this type are soluble metal carbonates, particularly sodium carbonate, sodium bicarbonates, soda ash, trona, or nacholite, which are mined mixtures of $Na_2CO_3$ and $NaHCO_3$. These carbonates or bicarbonates are ordinarily added to the grinding stage as aqueous solutions, but may also be added directly as solids. Preferred concentrations range from about 0.5% to 2.0% by weight, with about 1.0% more preferred.

Dispersants may also be added at other stages in the beneficiation process, and preferably should be the same dispersant throughout the system.

The residence time in the grinding step to reduce the shale to the desired particle size is dependent on a variety of factors: ball charge size distribution and weight, mill size, and mill revolution rate, among others. In one practiced grind, a 50% solids slurry of 28 average mesh shale (540 microns) is reduced down to 10 micron size in approximately sixty minutes in a tumbling ball mill using a ball charge of 550 g, a mill size of 8 inches, and a mill revolution rate of 72 rpm.

It is also advantageous and preferred to grind the shale to the desired size using a series of grinding stages. This results in a very substantial reduction in the number of kilowatt/hours of energy required for the grinding operation. In a preferred embodiment, three stages are used, the first of which may be either a rod or a tumbling ball mill, or a combination, while the second and third of which are ordinarily tumbling ball mills.

In the first stage, ¼" or greater diameter shale is reduced to average 150 micron size using standard balls of ½ inch or coarser, up to about 3 inch diameter. In the second grinding stage, the product of the first stage is reduced to an average diameter of 30 microns using balls ¼ inch or greater up to 1½ inch, ordinarily no more than 15% to 20% of which are ¼ inch diameter. In the third stage, the second stage product is reduced to the final desired size of from 8 to 40 microns using tumbling balls, 50% to 60% of which are ¼ inch in diameter.

While the staged grinding stages can occur sequentially, in another embodiment, the product of the first grinding stage can be separated into finer and coarser fractions: for example, greater than 37 microns maximum (10 to 12 microns average) are less than 37 microns maximum. The finer fraction is treated through the subsequent stages of the beneficiations process. The coarser fraction is reground in a second grinding stage and reseparated, again into greater and less than 37 micron fractions. The finer of the fractions is combined with the organic fraction of the first beneficiation and processed in a second beneficiation process. The coarser, second stage fraction is reground in a third stage all the way down to 6–10 microns maximum, combined with the organic fraction of the second beneficiation and processed in a third beneficiation, the beneficiations being essentially as described further below. This alternative staged grinding process can result in superior grades and recovery than single processing alone, as well as reduced energy requirements.

SCRUBBING STEP

Following grinding, it has been found that a necessary step, believed to be unique to the present invention, is a scrubbing step. When ground to the appropriate size, the ground oil shale is passed to a scrubbing stage where it is slurried with water and scrubbed A high shear impellar agitates the slurry in such a manner that there is particle-to-particle and particle-to-impellar rubbing action. These actions result in cleaning of the surface of the particles by removing or reducing of the presence of slime coatings, kerogen smear, or oxidized layers. The scrubbing also helps in breaking up the fine particle agglomerate and dispersing the particles throughout the slurry. This scrubbing, therefore, significantly increases the effectiveness of the conditioning and separation steps which follow, resulting in a product increased in both grade and recovery.

The addition of the commercial dispersant helps to keep the particles apart, and the dispersion chosen should be of a type that does not adversely influence the flotation process. Suitable dispersants include: sodium hexametaphosphate, soda ash, nacholite, trona and soluble metal carbonates and bicarbonates, preferably sodium, etc. That is, dispersants similar to those added to the size reduction step. Other recognized dispersants include: pyrophosphates, citric acid, boron compounds, tannins, phenols, polyacrylamides, polyvinyl alcohols, and sulfonates.

Additional make-up dispersant other than that added in the size reduction step may be added. For example, hexametaphosphate is consumed in grinding, therefore the amount must be brought back up to a level appropriate for scrubbing. The preferred scrubbing dispersants of the present invention are soda ash or sodium hexametaphosphate, added to the system in an aqueous solution. Again, preferably the same dispersant should be used throughout the process so as not to negate the effects of each other. The scrubbing residence time will vary with particle size distribution and the nature of the feed, but in general scrubbing time will vary from about 5 to 30 minutes. Comparative examples demonstrating the advantageousness of the scrubbing step to the system are shown in the Examples and Tables.

CONDITIONING STEP

Following scrubbing, the feed slurry is transferred to a conditioning step, in which agents are added to condition the slurry and make it amenable to the froth flotation separation. Two primary conditioning agents are employed.

The first, broadly termed collectors, are agents which change the surface characteristics of the solids in the slurry to make the organic component more hydrophobic, and therefore more susceptible to froth flotation separation. The primary collectors used are oils which are themselves hydrophobic and increase the grade and hydrophobicity of the kerogen when they interact with it. Preferred collectors include: pine oil, fuel oil, kerosene, and shale oil, which may be recycled from the process. Preferred concentrations range from 0.5 lb/ton to 5.0 lb/ton of solids (0.00025% to 0.0025%), and are more preferably about 0.5 to 1.5 lb/ton.

The second principal conditioning agent is a frother. The purpose of the frother is to produce sustaining frothing in the slurry when air or other gases are bubbled through it. An increase in the concentration of the frother in the conditioning step ordinarily helps increase kerogen recoveries. However, an excess amount leads to the production of excessive froth which results in lower selectivity, higher water usage and greater entrapment of mineral matter and lower grades. The preferred concentration of frother in the present invention is from between 0.5 to 1 lb per ton of solids in the suspension. Examples of preferred frothers include carbonyls, particularly methylisobutyl carbonyl (MIBC), polypropylene glycol, phenols, and short-chain alcoholic ethers. The collector and frother may also be the same agent if they act essentially as both types of agents, a preferred combined agent being pine oil.

Dispersants may also be added during the conditioning step along with collectors and frothers. As in the grinding step, the addition of dispersants selectively sequesters carbonate and silicate mineral materials which can thus be prevented from reporting to the float product. Dispersants help keep the particles separated and thus help the collector in the conditioning step be more selective. Preferred conditioning step dispersants are the same as those of the previous steps.

FROTH FLOTATION STEP

From the conditioning step, the conditioned feed is subjected to separation by froth flotation. In the froth flotation step, air or other gas bubbles are introduced into the conditioned slurry and the kerogen-rich particles, increased in hydrophobicity by the collector, are floated to the top of the flurry in a froth, while the kerogen-lean particles remain behind in suspension. The kerogen-rich froth is ordinarily skimmed from the surface of the slurry using paddles. Preferable solids concentration for most effective recovery is from 5% to 30% solids, preferably averaging 15% to 20% solids, which may be varied by diluting with additional water if necessary. The preferred air rate is from about 0.2 cubic feet per minute to 8 cubic feet per minute. The particular froth flotation process employed may be any process recognized in the art.

Other factors which can effect the effectiveness of the process include pH, froth collection time, and bubble size. By increasing or decreasing the pH of the aqueous slurry, the grade and the recoveries of the final product may be varied. More specifically, a reduction of pH results in a higher grade of recovery. The preferred pH in the present invention is approximately 6 to 9 and the pH can be controlled using known acids or bases. By changing the time for which the froth collection occurs during the froth flotation step, the grade and concentrate recovery can also be varied. This method may also be used to separate the lower amounts of higher grade concentrate from the middlings and the tailings. The preferred froth flotation residence time is approximately 5 to 25 minutes, more preferably from 10 to 20 minutes. Bubble size also has an effect on the selectivity and grade of the concentrate, particularly among the finer sizes of particles. Ordinarily the smaller the bubbles, the more preferable, and the better the recovery.

Multiple froth flotation stages may also be employed, consisting of scrubbing, conditioning, and froth flotation, in order to control the concentration and grade of the final kerogen product. Recycling of the kerogen-lean middlings back through the multiple flotations can also significantly increase organic recovery, up to 90% or greater.

OIL AGGLOMERATION/DEWATERING STEP

The froth concentrate from froth flotation ordinarily contains 10–20% solids and about 30% water. This concentration can be further upgraded by oil agglomeration and dewatering. By the addition of oil to the slurry and subjection to a controlled shear condition, the kerogen-rich materials and the oil shale tend to form an agglomerate which is substantially coarser than the mineral refuse. These agglomerates can then be separated effectively, and dewatered to about 8% moisture resulting in a preferred organic upgrading.

In a preferred embodiment, the froth concentrate is passed to a series of two tanks. In the first, light hydrocarbons such as naphtha are added. The mixture is agitated at a high shear rate, e.g. approximately 1000 rpm. The organic-rich materials is agglomerated into a microfine agglomerate in a 10–20% solids slurry. The residence time is ordinarily 1–2 minutes. This slurry is then passed to a second tank where heavier oils, such as shale oil which may be recycled, or refinery bottoms are added. The slurry is agitated at a slower rate, about 50 to 100 rpm for from 5 to 10 minutes, giving the agglomerates time to grow. Agglomerate size may be affected by the nature and concentration of the oil, and the residence time. The preferred agglomerate size is that which will pass over an inclined screen or sieve bend (Dutch State Mine-type, for example). The water and suspended mineral refuse passes through the screen leaving the organic-rich, dewatered agglomerates on top. The agglomerates so produced have from 8–10% moisture.

The organic rich material is ordinarily then subjected to further processing such as retorting, solvent extraction, hydrotreating or other processes for producing a usable hydrocarbonaceous product.

EXAMPLES

Scrubbing has been found to be an essential step to produce the most effective process operation. The reason is that, at the size level of the particles being processed, the kerogen-rich particles will develop kerogen smear and slime on their surface which ordinarily interferes with the effectiveness of the separation process. By scrubbing prior to separating, this smear is reduced and the particles become more dispersed, resulting in higher essential grades and recoveries.

To evaluate the effect of scrubbing on froth flotation separation, comparative experiments were run as follows: 100 g of R-5 zone oil shale and distilled water was ground in an 8 inch ABBE mill at 60 rpm and 0.1% sodium hexametaphosphate was added as a dispersant. The shale was ground to a nominal 10 micron diameter top size. After grinding, the mill was washed and the solids filtered. The solids were then repulped to 30% concentration with fresh distilled water. Those samples to be scrubbed were scrubbed using water jacketed Waring blender at an impellar speed of 2100 rpm with an additional oil % SHMP added. In the froth flotation, the aeration, percent conditioner (pine oil) conditioning time and solids concentration were varied as shown below. The froth was skimmed from the mixture surface, filtered and assayed.

The results are shown in Table I and Figure I.

TABLE I

| Test No. | Aeration (SCFM) | Pine Oil (lb/T) | Condition Time (Min.) | Solids, % | Scrub | Concentrate Yield (wt. %) | Grade (Volatile %) | Volatiles Recovery |
|---|---|---|---|---|---|---|---|---|
| 1 | 0.2 | 0.5 | 2 | 10 | No | 61.60 | 24.06 | 86.37 |
| 2 | 0.4 | 1.0 | 2 | 10 | No | 83.32 | 20.30 | 96.12 |
| 3 | 0.4 | 0.5 | 10 | 10 | No | 71.17 | 22.82 | 91.95 |
| 4 | 0.4 | 0.5 | 2 | 20 | No | 85.15 | 18.70 | 93.87 |
| 5 | 0.4 | 0.5 | 2 | 10 | 5 Min | 69.88 | 23.76 | 92.42 |
| 6 | 0.2 | 1.0 | 10 | 10 | No | 71.63 | 22.78 | 91.85 |
| 7 | 0.2 | 1.0 | 2 | 20 | No | 82.19 | 20.15 | 93.31 |
| 8 | 0.2 | 1.0 | 2 | 10 | 5 | 70.97 | 22.56 | 92.81 |
| 9 | 0.2 | 0.5 | 10 | 20 | No | 75.70 | 20.34 | 89.26 |
| 10 | 0.2 | 0.5 | 10 | 10 | 5 | 58.29 | 24.94 | 85.50 |
| 11 | 0.2 | 0.5 | 2 | 20 | 5 | 70.00 | 21.09 | 89.20 |
| 12 | 0.4 | 1.0 | 10 | 20 | No | 90.24 | 18.75 | 96.95 |
| 13 | 0.4 | 1.0 | 10 | 10 | 5 | 79.19 | 21.55 | 95.25 |
| 14 | 0.4 | 1.0 | 2 | 20 | 5 | 90.84 | 18.84 | 97.79 |
| 15 | 0.4 | 0.5 | 10 | 20 | 5 | 82.74 | 18.94 | 93.98 |
| 16 | 0.2 | 1.0 | 10 | 20 | 5 | 77.95 | 20.59 | 92.93 |

What is claimed is:

1. A process for beneficiating oil shale which has been reduced to a size suitable for grinding, comprising the steps of:

(a) grinding said shale in an aqueous medium under conditions and using a suitable dispersant to a mixture of particles averaging about 40 microns or less in diameter wherein a substantial proportion of the mineral matter is in substantially kerogen-free particles and a substantial proportion of the kerogen is in generally larger, kerogen-rich particles;

(b) scrubbing the particles in the presence of a suitable dispersant with sufficient turbulence to reduce contaminants on the particles surface and separate adhering kerogen-poor particles of mineral matter and kerogen-rich particles;

(c) mixing a suitable collecting agent and frothing agent with the scrubbed mixture under conditions suitable to cause a coating of the said collecting agent and frothing agent to be formed on the kerogen-rich particles within the mixture and increasing their hydrophobicity;

(d) introducing air bubbles into the mixture of the said kerogen-rich particles by froth flotation, whereby the air bubbles adhere to the kerogen-rich particles causing them to float as a froth above the mixture containing the kerogen-poor particles; and (e) separating the kerogen-rich froth from the kerogen-poor liquid mixture.

2. The process for beneficiating oil shale as claimed in claim 1 wherein said froth recovered in step (e) is agglomerated using a liquid hydrocarbon oil.

3. The process as claimed in claim 2 wherein the kerogen agglomerated kerogen-rich fraction is further separated into (a) a fraction comprising kerogen and agglomerating oil, and (b) a fraction comprising water and mineral refuse.

4. The process as claimed in claim 1 wherein the dispersant used throughout the process is selected from the group comprising phosphates and carbonates.

5. The process as claimed in claim 4 wherein the dispersants are selected from the group comprising sodium hexametaphosphate, soda ash, trona, nacholite, sodium carbonate and sodium bicarbonate.

6. The process as claimed in claim 1 wherein the collecting agents are hydrocarbonaceous liquids which will increase the hydrophobicity of said kerogen-rich particles.

7. The process as claimed in claim 6 wherein the hydrocarbonaceous liquids are selected from the group comprising pine oil, fuel oil, kerosene, and shale oil.

8. The process as claimed in claim 7 wherein said shale oil may be recycled from the process.

9. The process as claimed in claim 6 wherein the concentration of said collecting agent is from about 0.5 lb/ton to about 5.0 lb/ton of solids.

10. The process as claimed in claim 9 wherein said concentration is from about 0.5 to 1.5 lb/ton of solids.

11. The process as claimed in claim 1 wherein the frothing agent is selected from the group comprising carbonyl compounds, polypropylene glycol, phenols, and short-chain alcoholic ethers.

12. The process as claimed in claim 11 wherein the carbonyl compound is methylisobutylcarbonyl.

13. The process as claimed in claim 11 wherein the concentration of said frothing agent is from about 0.5 to 1.0 lb/ton of solids.

14. The process as claimed in claim 1 wherein the collecting agent and the frothing agent are both pine oil.

15. The process as claimed in claim 1 wherein the concentration of solids in said froth flotation step (d) is from about 5% to 30%.

16. The process as claimed in claim 15 wherein the solids concentration is from about 15% to 20%.

17. The process as claimed in claim 1 wherein the air bubble introduction rate in froth flotation step (d) is from about 0.2 to about 8.0 cubic feet per minute.

18. The process as claimed in claim 1 wherein the pH of the froth flotation step (d) is from 6 to 9.

19. The process as claimed in claim 1 wherein the residence time of the mixture in said froth flotation step (d) is from about 5 to 25 minutes and more preferably from 10 to 20 minutes.

20. The process of claim 2 wherein the oil agglomeration further comprises the method of treating the froth in the first step with a light hydrocarbon and subjecting it to a high shear rate agitation, and in a second step with a heavier hydrocarbon selected from the group comprising pine oil, fuel oil, kerosene, and shale oil and subjecting it to a slower agitation rate.

21. The process as claimed in claim 1 where the grinding of step (a) can be done in a sequential series of grinding stages.

22. The process as claimed in claim 21 wherein the product of each grinding step is separated into sized fractions, the finer of which is subjected to the rest of the beneficiating process and the coarser of which is passed to the next sequential grinding step.

23. The process as claimed in claim 1 wherein steps 1(c), (d) and (e) together are repeated.

* * * * *